US009187847B2

(12) United States Patent
Yoon et al.

(10) Patent No.: US 9,187,847 B2
(45) Date of Patent: Nov. 17, 2015

(54) METHOD FOR PREPARING CARBON FIBER AND PRECURSOR FIBER FOR CARBON FIBER

(75) Inventors: Joon Young Yoon, Gyeongsangbuk-do (KR); Eun Jeong Cho, Gyeonggido (KR)

(73) Assignee: KOLON INDUSTRIES, INC., Gwacheon-si (KR)

( * ) Notice: Subject to any disclaimer, the term of this patent is extended or adjusted under 35 U.S.C. 154(b) by 547 days.

(21) Appl. No.: 13/638,706

(22) PCT Filed: Mar. 31, 2011

(86) PCT No.: PCT/KR2011/002236

§ 371 (c)(1),
(2), (4) Date: Jan. 17, 2013

(87) PCT Pub. No.: WO2011/122881

PCT Pub. Date: Oct. 6, 2011

(65) Prior Publication Data

US 2013/0113130 A1 May 9, 2013

(30) Foreign Application Priority Data

Mar. 31, 2010 (KR) ..... 10-2010-0029598
Mar. 31, 2011 (KR) ..... 10-2011-0029486

(51) Int. Cl.

| | |
|---|---|
| ***D01D 10/02*** | (2006.01) |
| ***D01F 6/18*** | (2006.01) |
| ***D01F 9/22*** | (2006.01) |
| ***D02J 1/22*** | (2006.01) |
| ***D01D 5/12*** | (2006.01) |

(52) U.S. Cl.

CPC ..... *D01D 10/02* (2013.01); *D01D 5/12* (2013.01); *D01F 6/18* (2013.01); *D01F 9/225* (2013.01); *D02J 1/22* (2013.01)

(58) Field of Classification Search

CPC ..... D01D 5/12; D01D 10/02; D01F 6/18
See application file for complete search history.

(56) References Cited

U.S. PATENT DOCUMENTS

| | | | |
|---|---|---|---|
| 2007/0183960 | A1 | 8/2007 | Ikeda et al. |
| 2010/0003515 | A1 | 1/2010 | Tanaka et al. |

FOREIGN PATENT DOCUMENTS

| | | | |
|---|---|---|---|
| DE | 40 02 302 | A1 | 8/1991 |
| EP | 1 719 829 | A1 | 11/2006 |
| JP | 2008-163537 | A | 7/2008 |
| JP | 2008-248219 | A | 10/2008 |

OTHER PUBLICATIONS

International Searching Authority, International Search Report of PCT/KR2011/02236 dated Dec. 29, 2011.

*Primary Examiner* — James Sanders
(74) *Attorney, Agent, or Firm* — Sughrue Mion, PLLC

(57) ABSTRACT

The method for preparing a carbon fiber of the present invention includes the steps of: preparing a polyacrylonitrile-based polymer solution; spinning the polyacrylonitrile-based polymer solution to prepare a precursor fiber for a carbon fiber, the precursor fiber having a water content of 20-50%; converting the precursor fiber for a carbon fiber into a preliminary flame-retarded fiber while stretching the precursor fiber for a carbon fiber at an elongation rate of −10~−0.1% or 0.1~5% at 180~220° C. in air; converting the preliminary flame-retarded fiber into a flame-retardant fiber while stretching the preliminary flame-retarded fiber at an elongation rate of −5~5% at 200~300° C. in air; and heating the flame-retardant fiber under an inert atmosphere to carbonize the flame-retardant fiber.

9 Claims, No Drawings

METHOD FOR PREPARING CARBON FIBER AND PRECURSOR FIBER FOR CARBON FIBER

TECHNICAL FIELD

The present invention relates to a method of preparing a carbon fiber and a precursor fiber for a carbon fiber.

BACKGROUND ART

Carbon fiber is widely used as a fiber for reinforcing a composite material in common industries such as those pertaining to automobiles, civil engineering and construction, pressure vessels, windmill blades and the like in addition to the sports and aerospace industries because it has high specific strength and specific elasticity compared to other fibers. Therefore, there is a strong need to increase the productivity of carbon fiber and improve the production stability of carbon fiber.

Polyacrylonitrile (PAN)-based carbon fiber, which is the most widely-used carbon fiber, is industrially produced by wet-spinning, dry-spinning or wet-dry-spinning a PAN-based polymer (precursor)-containing solution to obtain a precursor fiber, heating the precursor fiber under an oxidative atmosphere to convert the precursor fiber into a flame-retardant fiber and then heating the flame-retardant fiber under an inert atmosphere to carbonize the flame-retardant fiber to eventually form the carbon fiber.

The application range of such carbon fiber is becoming wider, and such carbon fiber is required to have high performance.

Therefore, various methods for preparing a high-performance carbon fiber have been actively researched. However, since a conventional precursor fiber for preparing a carbon fiber has a water content of about 4% or less, it is difficult to additionally stretch the precursor fiber to improve physical properties in a flame-retarding process, and thus it is difficult to improve the strength of the finally-produced carbon fiber.

DISCLOSURE

Technical Problem

The present invention intends to provide a method of preparing a carbon fiber, in which a precursor fiber is freely additionally stretched or contracted in a flame-retarding process and a carbonization process, thus preparing a high-performance carbon fiber, and to a precursor fiber for preparing the carbon fiber.

Technical Solution

An aspect of the present invention provides a method of preparing a carbon fiber, including the steps of: preparing a polyacrylonitrile-based polymer solution; spinning the polyacrylonitrile-based polymer solution to prepare a precursor fiber for a carbon fiber, the precursor fiber having a water content of 20~50%; converting the precursor fiber for a carbon fiber into a preliminary flame-retarded fiber while stretching the precursor fiber for a carbon fiber at an elongation rate of −10~−0.1% or 0.1~5% at 180~220° C. in air; converting the preliminary flame-retarded fiber into a flame-retardant fiber while stretching the preliminary flame-retarded fiber at an elongation rate of −5~5% at 200~300° C. in air; and heating the flame-retardant fiber under an inert atmosphere to carbonize the flame-retardant fiber.

Here, the step of preparing the precursor fiber for a carbon fiber may include the step of spinning the polyacrylonitrile-based polymer solution to form filaments and injecting the filaments into a coagulating bath to coagulate the filaments and then water-washing, stretching, oiling, drying and compacting the coagulated filaments.

Further, in the step of converting the precursor fiber into the preliminary flame-retarded fiber, the precursor fiber may be stretched at an elongation rate of 0.1~5% in order to improve the intensity characteristic of a carbon fiber.

Further, in the step of converting the preliminary flame-retarded fiber into the flame-retardant fiber, the preliminary flame-retarded fiber may be stretched at an elongation rate of 0~5%.

Further, in the step of carbonizing the flame-retarded fiber, the flame-retarded fiber may be precarbonized at a temperature of 300~800° C. under an inert atmosphere, and be then stretched and carbonized at a temperature of 1000~3000° C. under an inert atmosphere.

Further, in the step of carbonizing the precarbonzed fiber, the precarbonized fiber may be stretched at an elongation rate of −5.0~5.0%, preferably 3.1~5.0%.

In the method, after the step of preparing the precursor fiber for a carbon fiber, the stretching may be performed such that a total elongation rate of a carbon fiber to the prepared precursor fiber is −10.0~10.0%, preferably, 5.1~10.0%.

Another aspect of the present invention provides a precursor fiber for preparing a carbon fiber, wherein the precursor fiber is a polyacrylonitrile-based fiber and has a water content of 20.0~50.0%.

Advantageous Effects

According to the method of preparing a carbon fiber of the present invention, since a high water-content precursor fiber for carbon fiber is used, preliminary flame-retarding can be performed prior to flame-retarding, and the elongation rate of carbon fiber can be increased, so that the mechanical properties of carbon fiber can be improved, with the result that high-performance carbon fiber can be prepared.

BEST MODE

Hereinafter, the present invention will be described in detail.

The precursor fiber for a carbon fiber includes a polyacrylonitrile (PAN)-based polymer. Here, the polyacrylonitrile-based polymer is polymer including acrylonitrile as a main component. Specifically, the polyacrylonitrile-based polymer is a polymer including acrylonitrile in an amount of 85 mol % or more based on the total amount of monomers.

The polyacrylonitrile-based polymer may be obtained by solution-polymerizing acrylonitrile (AN) monomer-containing solution using a polymerization initiator. The polyacrylonitrile-based polymer may also be obtained by suspension polymerization, emulsion polymerization or the like in addition to solution polymerization.

The monomers may include monomers copolymerizable with acrylonitrile as well as acrylonitrile. The monomers copolymerizable with acrylonitrile serve to accelerate flame-retardation, and examples thereof may include acrylic acid, methacrylic acid, itaconic acid and the like.

Generally, after the polymerization of monomers, a neutralization process is subsequently performed using a polymerization terminator. The neutralization process using the polymerization terminator serves to prevent a spinning solution containing the obtained polyacrylonitrile-based polymer from rapidly coagulating at the time of spinning the solution.

Generally, ammonia may be used as the polymerization terminator, but the present invention is not limited thereto.

Monomers including acrylonitrile as a main component are polymerized to obtain a polymer, and then the obtained polymer is neutralized using the polymerization terminator to prepare a solution including a polyacrylonitrile-based polymer which is bonded with ammonium ions in the form of a salt.

Meanwhile, the polymerization initiator used in the polymerization of monomers is not particularly limited. Preferably, as the polymerization initiator, oil-soluble azo compounds, water-soluble azo compounds, peroxides and the like may be used. Among these compounds, in terms of safety, treatability and industrial polymerization efficiency, water-soluble azo compounds, which do not cause the generation of oxygen inhibiting the polymerization when they are decomposed, may be preferably used, and, in the case of solution polymerization, in terms of solubility, oil-soluble azo compounds may be preferably used. Specific examples of the polymerization initiators may include 2,2'-azobis(4-methoxy-2,4-dimethylvaleronitrile), 2,2'-azobis(2,4'-dimethylvaleronitrile), 2,2'-azobisisobutyronitrile, and the like.

The polymerization temperature may be changed depending on the kind and amount of the polymerization initiator, but, preferably, may be 30° C. to 90° C.

The solution including the polyacrylonitrile-based polymer may have a polymer content of 10 to 25 wt %.

When this solution is used as a spinning solution for preparing a precursor fiber for a carbon fiber, there are advantages in that a solvent can be easily removed during a spinning process, in that it is possible to prevent tar or impurities from being produced during a flame-retarding process, and in that the density of filaments can be maintained uninform.

The obtained solution including the polyacrylonitrile-based polymer can be used as a spinning solution for preparing a precursor fiber for a carbon fiber. The precursor fiber for a carbon fiber can be obtained by spinning this spinning solution. The spinning solution may include an organic or inorganic solvent together with the polyacrylonitrile-based polymer. Examples of the organic solvent may include dimethylsulfoxide, dimethylformamide, dimethylacetamide and the like.

The spinning method may be a dry spinning method, a wet spinning method or a dry-wet spinning method.

Here, the dry spinning method is a method of concentrating and solidifying the spinning solution by discharging the spinning solution through a spinning nozzle under a high-temperature gas atmosphere and thus volatilizing a solvent. In this method, since the winding speed becomes the volatilization speed of the solvent, there is a problem in that the length of a closed spinning chamber increases as the winding speed increases.

Further, the wet spinning method is a method of discharging the spinning solution in a coagulating bath through a spinning nozzle. In this method, since the spinning solution swells three times or more and coagulates immediately after the spinning solution is discharged through the spinning nozzle, spinning draft does not greatly increase even when the winding speed increases. However, in this method, a substantial draft rate rapidly increases, so that the yarn may be severed, with the result that it is difficult to set the winding speed high.

Further, in the dry-wet spinning method, the spinning solution is discharged in the air (air gap), surface-crystallized and then coagulated in a coagulating bath, so that the rapid increase in a draft rate may be substantially compensated by the solution discharged in the air gap, with the result that high-speed spinning can be performed.

In addition, a melting spinning method and other commonly known spinning methods may be used.

Preferably, the spinning solution is discharged through a spinning nozzle by a wet spinning method or a dry-wet spinning method, and the discharged spinning solution is introduced into a coagulating bath to coagulate fibers.

The coagulation rate or stretching method can be suitably determined depending on the use of refractory fiber or carbon fiber.

The coagulating bath may be filled with a coagulation accelerator in addition to a solvent such as dimethylsulfoxide, dimethylformamide, dimethylacetamide or the like. As the coagulation accelerator, a solvent, which does not dissolve a polyacrylonitrile-based polymer and is used in the spinning solution, may be used. An example of the coagulation accelerator may be water.

The temperature of the coagulating bath and the amount of the coagulation accelerator may be suitably determined depending on the use of refractory fiber or carbon fiber.

The precursor fiber for a carbon fiber may be prepared by the steps of injecting the spun polyacrylonitrile-based polymer solution into a coagulating bath to form and coagulate filaments and then water-washing, stretching, oiling, drying and compacting the coagulated filaments. In this case, the filaments may be coagulated and then directly stretched in a stretching bath without water-washing the filaments, or may also be coagulated, water-washed and then additionally stretched in a stretching bath. Further, in order to prepare a strong precursor fiber for a carbon fiber, after an oil solution is added to the filaments, the filaments may be multi-axially stretched at low power or may be stretched by high-temperature steam at high power.

The oil solution is added to the filaments in order to prevent single fibers from adhering to each other. Preferably, the oil solution may be a silicon oil solution. The silicon oil solution may be a modified silicon solution, more preferably, a reticular modified silicon solution having high heat resistance.

The precursor fiber for a carbon fiber, obtained in this way, may have a single fiber fineness of 0.01~3.0 dtex, preferably, 0.05~1.8 dtex, and more preferably 0.8~1.5 dtex. When the single fiber fineness of the precursor fiber is excessively small, a carbon fiber yarn may be severed by the contact with a roller or guide, so that the process of fabricating yarn and the process of calcining carbon fiber cannot be accurately performed repeatedly in the same manner. Further, when the single fiber fineness thereof is excessively large, the difference in structure between the inner and outer layers of each single fiber after flame-retardation increases, the subsequent carbonization process cannot be easily performed, and the tensile strength and tensile elastic modulus of the obtained carbon fiber decreases. That is, when the single fiber fineness thereof deviates from the range, the plasticity efficiency of the carbon fiber may deteriorate rapidly. In the present invention, the term "single fiber fineness (dtex)" is defined as the weight (g) per 10000 m of single fiber.

The crystal orientation of the precursor fiber for a carbon fiber according to the present invention may be 85% or more, preferably, 90% or more. When the crystal orientation thereof is less than 85%, the strength of the obtained precursor fiber may become low.

In particular, it is preferred that the precursor fiber for a carbon fiber according to the present invention have a water content of 20~50%. The water content of the precursor fiber for a carbon fiber may be controlled by any one of the steps of injecting the spun polyacrylonitrile-based polymer solution into a coagulating bath to coagulate filaments and then water-washing, stretching, oiling, drying and compacting (heat-treating) the coagulated filaments. Preferably, the water content of the precursor fiber for a carbon fiber may be controlled by controlling the heat treatment temperature in the process of drying and heat treatment after the final crystal orientation of the precursor fiber reaches 85% or more, or may be controlled by controlling the concentration and amount of the oil solution used to improve the processability of the carbon fiber precursor in the process of carbonizing the carbon fiber precursor.

Generally, the water content of the carbon fiber precursor may be maintained about 4% at a level of process water content. In this case, the strength and elongation rate of the carbon fiber precursor can be improved by drying and compacting the carbon fiber precursor in the process and then finally stretching and the drying the carbon fiber precursor.

However, the present invention is based on the fact that the mechanical properties of carbon fiber are more effectively improved by improving the elongation and relaxation characteristics in the carbonization process more than by improving the physical properties of the carbon fiber precursor. Therefore, when the carbon fiber precursor is prepared, the carbon fiber precursor may be heat-treated at a temperature of 100~180° C. rapidly or only the surface of the carbon fiber precursor may be lightly heat-treated using a far-infrared heater. Because of characteristics of the process, when the water content of the carbon fiber precursor is less than 20%, the water content thereof can be improved by adding a low-concentration oil solution to the carbon fiber precursor after final drying.

When the water content of the precursor fiber for carbon fiber is controlled in a range of 20~50%, the stretchability and contractibility of the precursor fiber can be increased in the flame-retarding and carbonization processes. Further, in order to greatly increase the strength of carbon fiber by improving the mechanical properties of the carbon fiber, it is preferable to improve the stretchability of the precursor fiber.

Generally, the precursor fiber for carbon fiber is obtained, and then a flame-retarding process is performed, and simultaneously a stretching process may be performed. When the obtained water content of the precursor fiber is about 4%, the elongation rate of the finally-obtained carbon fiber is at most −10~5%, which is low. Further, the stretching process may be performed even in the carbonization process after the flame-retarding process, and, in this case, the elongation rate of the carbon fiber is at most −3~3% (which is further lower) based on that of the precursor fiber in the prior step. Consequently, the carbonization condition of a general carbon fiber precursor gives priority to the process stabilization attributable to contraction rather than to the improvement of mechanical properties attributable to stretching.

However, when a precursor fiber for carbon fiber having a water content of 20~50% is used, the precursor fiber can be additionally stretched under the condition of high temperature and high orientation because water serves as a plasticizer in the flame-retarding process.

When the elongation rate is increased in the flame-retardation and carbonization processes, ultimately, the mechanical properties of carbon fiber can be improved.

Thus, according to an embodiment of the present invention, a carbon fiber precursor having high water content is used. Preferably, a carbon fiber precursor having a water content of 20~50% may be used. When the water content of the carbon fiber precursor is excessively high, a difference in the degree of oxidation is caused between the surface and inside of the carbon fiber precursor during the flame-retarding and carbonization processes, so that a sheath-core effect is created or the carbon fiber precursor becomes hollow. Further, owing to this condition, the peroxidation of the carbon fiber precursor takes place, so that the strength of the carbon fiber is substantially decreased or the process cannot be easily performed. Therefore, it is preferred that the water content of the carbon fiber precursor be 50% or less.

Specifically, a process of preparing a carbon fiber using a carbon fiber precursor having high water content and including a polyacrylonitrile-based polymer in the form of a salt will be described.

In the process of preparing a carbon fiber using a carbon fiber precursor having high water content, this process being accompanied by general flame-retardation treatment. However, in this case, high-temperature heat treatment is immediately and rapidly performed at 200~300° C., so that the carbon fiber precursor rapidly contracts, and simultaneously the weak yarn in the carbon fiber precursor bundle is severed, and the tension of the carbon fiber precursor in oxidation treatment becomes nonuniform, with the result that it is difficult to control process stability, and a part of the carbon fiber precursor may be rapidly burned because of the rapid heat treatment. Particularly, since the contraction force of the carbon fiber precursor is exhibited to the highest degree at a temperature range of 200~240° C., it is required to pay attention to process stabilization. Considering such a problem, in the present invention, preliminary flame-retardation may be carried out. In this case, it is preferred that the temperature in the flame-retardation be higher than the temperature in the preliminary flame-retardation.

Here, the preliminary flame-retardation treatment is performed so that the carbon fiber precursor having a high water content of 20~50% is preliminarily flame-retarded at a temperature range of 180~220° C. while being stretched at an elongation rate of −10~−0.1% or 0.1~5%, considering that the carbon fiber precursor is contracted to a maximum elongation rate of 5%. That is, since the shock caused by the contraction of the carbon fiber precursor can be relaxed at this temperature range before the carbon fiber precursor is introduced into a flame-retardation furnace, both the effect of process stabilization and the effect of improvement of physical properties can be accomplished.

In the present invention, the temperature in the preliminary flame-retardation treatment is determined depending on the contraction rate of carbon fiber and the plasticity of moisture. Therefore, if the temperature in the preliminary flame-retardation treatment is lower than 180° C., there is a problem in that the carbon fiber precursor is insufficiently compacted, and, if the temperature therein is higher than 220° C., there is a problem in that water rapidly volatilizes, thus rapidly deteriorating the stretchability of the carbon fiber precursor.

Further, in the preliminary flame-retardation treatment, when the elongation rate of the carbon fiber precursor is more than 5%, there is a problem in that the carbon fiber precursor is excessively hardened, and thus a part of the carbon fiber precursor is severed, thereby causing the firing in the flame-retardation process. Therefore, it is preferred that the maximum elongation rate be 5% or less, and that the elongation rate be 0.1~5% in terms of the improvement of strength.

Subsequently, the carbon fiber precursor preliminarily flame-retarded in this way is stretched and simultaneously flame-retarded at a temperature of 200~300° C.

In this case, the elongation rate of the flame-retarded carbon fiber precursor to the preliminarily flame-retarded carbon fiber precursor may be −5~5%. Here, a carbon fiber precursor having a high water content is preliminarily flame-retarded and then flame-retarded to be imparted with high strength. Therefore, the elongation rate of the flame-retarded carbon fiber precursor is higher than that of the carbon fiber precursor obtained by general flame-retardation.

That is, in order to prepare a carbon fiber having high strength, it is preferred that the elongation rate of the flame-retarded carbon fiber precursor to the preliminarily flame-retarded carbon fiber precursor be 0~5%. It is more preferred that the elongation rate thereof be 0~0.1%.

Subsequently, the flame-retarded carbon fiber precursor is stretched and simultaneously precarbonized at a temperature of 300~800° C. under an inert gas atmosphere according to the purpose, and then further stretched and simultaneously carbonized at a high temperature of 1000~3000° C. under an inert gas atmosphere according to the purpose to prepare a carbon fiber.

The precarbonization or carbonization of the flame-retarded carbon fiber precursor is performed under an inert gas atmosphere. Examples of the gas used in the inert gas atmosphere may include nitrogen, argon, xenon and the like. The temperature in the carbonization of the flame-retarded carbon fiber precursor may be set to 1000~3000° C. Generally, as the temperature in the carbonization thereof increases, the tensile elastic modulus of the obtained carbon fiber increases, but the tensile strength thereof is the highest at 1300~1500° C. Therefore, in order to increase both the tensile strength and the tensile elastic modulus of the carbon fiber, the maximum temperature in the carbonization thereof may be 1200~1700° C., preferably, 1300~1500° C.

Further, considering that carbon fiber is used to manufacture an aircraft, it is important to reduce the weight of carbon fiber, and, in terms of increasing the tensile elastic modulus of carbon fiber, it is preferred that the maximum temperature in the carbonization of the carbon fiber precursor be 1700~2300° C. As the maximum temperature in the carbonization thereof increases, the tensile elastic modulus of carbon fiber increases, but the carbon fiber may be graphitized. Owing to the graphitization of the carbon fiber, the carbon face of the carbon fiber can be easily buckled by the growth and lamination thereof, with the result that the compression strength of carbon fiber may decrease. Therefore, the temperature in the carbonization process is determined in consideration of the balance between the tensile elastic modulus and the compression strength of carbon fiber.

Meanwhile, after the oxidation stabilization, the elongation rate of the carbon fiber precursor in the carbonization may be −10.0~5.0%, preferably −5.0~5.0%, and preferably 3.1~5.0%. The reason why the elongation rate can be increased at the time of carbonization is that the carbon fiber precursor having high water content has undergone preliminary retardation and flame-retardation processes.

As described above, when the carbon fiber which has been prepared by preliminarily flame-retarding, flame-retarding and then carbonizing a carbon fiber precursor having high water content is stretched such that the elongation rate of the carbon fiber to the carbon fiber precursor is −10~10%, preferably, 5.1~10.0%, this is preferable in terms of the improvement of mechanical properties of the carbon fiber and the improvement of process stability.

The obtained carbon fiber can be electrolyzed in order to reform the surface thereof. As the electrolyte solution used in the electrolyzation of the carbon fiber, acid solutions, such as sulfuric acid, nitric acid, hydrochloric acid and the like, and alkali aqueous solutions, such as sodium hydroxide, potassium hydroxide, tetraethylammonium hydroxide, ammonium carbonate, ammonium bicarbonate and salts thereof, may be used. Here, the amount of electricity used to electrolyze the carbon fiber may be suitably selected depending on the degree of carbonization of the carbon fiber to be applied.

In the fiber-reinforced composite material obtained by the electrolyzation of the carbon fiber, the adhesion between the fiber-reinforced composite material and the carbon fiber matrix can be optimized, so that the problem of the composite material becoming brittle due to very strong adhesion or the problem of the strength characteristics of the composite material in a nonfibrous direction not being exhibited because the adhesion between the composite material and resin becomes poor although the tensile strength of the composite material in a fibrous direction can be overcome. Therefore, in the obtained fiber-reinforced composite material, the strength characteristic thereof is uniformly exhibited in both the fibrous direction and nonfibrous direction.

After the electrolyzation of the carbon fiber, the electrolyzed carbon fiber may be sized. The sizing agent used to size the electrolyzed carbon fiber may be suitably selected from sizing agents compatible with resins according to the kind of resin that is used.

The carbon fiber of the present invention, which is a prepreg, can be used to manufacture aircraft members, pressure container members, automobile members and sports equipment such as fishing rods, golf clubs and the like using various forming methods such as autoclave molding, resin transfer molding, filament winding and the like.

MODE FOR INVENTION

Hereinafter, the present invention will be described in more detail with reference to the following Examples, but the scope of the present invention is not limited to these Examples.

EXAMPLES 1 TO 4

95 mol % of acrylonitrile, 3 mol % of methacrylic acid and 2 mol % of itaconic acid were polymerized by solution polymerization using dimethylsulfoxide as a solvent, and then ammonia was added thereto in an amount equivalent to that of the itaconic acid to neutralize the reaction product to prepare a polyacrylontrile-based copolymer in the form of an ammonium salt, thereby obtaining a spinning solution including 22 wt % of the polyacrylontrile-based copolymer.

The spinning solution was discharged through two spinning nozzles (each having a temperature of 45° C., a diameter of 0.08 mm and 6000 holes), and was then introduced into a coagulating bath maintained at 45° C. and filled with an aqueous solution including 40% of dimethylsulfoxide to prepare a coagulated yarn.

The coagulated yarn was water-washed and then stretched five times in hot water, and then a reticular modified silicon oil solution was added thereto to obtain an intermediate drawn yarn.

This intermediate drawn yarn was dried using a hot roller, and was then stretched in pressurized steam to obtain a polyacrylonitrile-based fiber bundle having a total elongation rate of 10, a single fiber fineness of 1.5 dtex and a filament number of 12000. The obtained polyacrylonitrile-based fiber bundle is referred to as a precursor fiber for a carbon fiber.

In this case, after stretching the intermediate drawn yarn in pressurized steam, in the process of heat-treating the stretched intermediate drawn yarn, the heat treatment temperature was controlled at 80~120° C., thus obtaining precursor fibers having different water contents. In this case, the water content can be obtained by converting the amount of the spinning solution discharged through the spinning nozzle into the fineness of wound precursor fibers and the winding speed of the precursor fibers, and can be analyzed as follows using GC-MASS (Varian 4000 GC-MS).

GC-MASS Analysis

Instrument: Varian 4000 GC-MS

Stationary Phase: VF-5 ms (30 m×0.25 mm×0.25 um)

Mobile Phase: He, 1.0 ml/min

Temperature Programming: From 80° C., 2 min to 280° C., 8 min (@20 C/min)

Injection: 0.4 ul, Split-20:1, 250° C.

Detection: EI mode (28-500 m/z scan)

Each of the obtained polyacrylonitrile-based fiber bundles was preliminarily flame-retarded (accompanied by stretching) at a winding speed of 4 m/min at 200° C. for 6 minutes under an air atmosphere without twisting, and was then flame-retarded (accompanied by stretching) in a 4-stage hot air oven having a temperature range of 220~270° C. for 80 minutes.

Subsequently, the flame-retarded polyacrylonitrile-based fiber bundle was precarbonized at 400~700° C. under an inert atmosphere to remove off-gas, and then finally carbonized (accompanied by stretching) at 1350° C. to prepare a carbon fiber having improved strength.

In Examples 1 to 4, at the time of the preliminary flame-retardation, flame-retardation and carbonization, elongation rates were different from each other as given in Table 1 below. In this case, it will be understood that the elongation rate in each process is based on the difference in processing rates before and after each process.

EXAMPLE 5

A carbon fiber was prepared using a precursor fiber having the same water content as that of the precursor fiber of Example 1, except that the elongation rate of the precursor fiber was set to 1.5% during the flame-retardation thereof.

EXAMPLE 6

A carbon fiber was prepared using a precursor fiber having the same water content as that of the precursor fiber of Example 1, except that the elongation rate of the precursor fiber was set to −2.5% during the flame-retardation thereof, an that the elongation rate thereof was set to 0.5% during the carbonization thereof.

REFERENCE EXAMPLE 1

A carbon fiber was prepared using a precursor fiber having the same water content as that of the precursor fiber of Example 1, except that the flame-retardation of the precursor fiber was performed at 220~270° C. for 80 minutes under an air atmosphere (accompanied by stretching the precursor fiber at an elongation rate of 1.5%) without carrying out the preliminary flame-retardation of the precursor fiber.

Subsequently, the flame-retarded precursor fiber was precarbonized at 400~700° C. under an inert atmosphere, and then finally carbonized at 1350° C. (accompanied by stretching the precursor fiber at an elongation rate of 1.5%).

In this case, there is a disadvantage in that the oxidation stabilization and carbonization processes of the precursor fiber are not stable in terms of processability because the precursor fiber for a carbon fiber is partially severed. Particularly, there is a disadvantage in that the partially-severed precursor fiber deteriorates the strength of a carbon fiber, and causes the carbon fiber to be severed because it remains as a wrap in the process.

COMPARATIVE EXAMPLE 1

95 mol % of acrylonitrile, 3 mol % of methacrylic acid and 2 mol % of itaconic acid were polymerized by solution polymerization using dimethylsulfoxide as a solvent, and then ammonia was added thereto in an amount equivalent to that of itaconic acid to neutralize the reaction product to prepare a polyacrylontrile-based copolymer in the form of an ammonium salt, thereby obtaining a spinning solution including 22 wt % of the polyacrylontrile-based copolymer.

The spinning solution was discharged through two spinning nozzles (each having a temperature of 45° C., a diameter of 0.08 mm and 6000 holes), and was then introduced into a coagulating bath maintained at 45° C. and filled with an aqueous solution including 40% of dimethylsulfoxide to prepare a coagulated yarn.

The coagulated yarn was water-washed and then stretched four times in hot water, and then a reticular modified silicon oil solution was added thereto to obtain a drawn yarn.

This drawn yarn was dried using a hot roller of 150° C., and was then stretched in pressurized steam to obtain a polyacrylonitrile-based fiber bundle having a total elongation rate of 10, a single fiber fineness of 1.5 dtex and a filament number of 12000. The polyacrylonitrile-based fiber bundle was heat-treated at 135° C. by a hot air dryer to obtain a precursor fiber for a carbon fiber.

The water content of the obtained precursor fiber for a carbon fiber, measured in the same manner as in Example 1, was 4.5%.

The obtained polyacrylonitrile-based fiber bundle was flame-retarded at a winding speed of 4 m/min in a 4-stage hot air oven having a temperature range of 220~270° C. for 80 minutes under an air atmosphere (accompanied by stretching the polyacrylonitrile-based fiber bundle at an elongation rate of 2.5%) without twisting the polyacrylonitrile-based fiber bundle.

Subsequently, the flame-retarded polyacrylonitrile-based fiber bundle was precarbonized at 400~700° C. under an inert atmosphere, and then finally carbonized at 1350° C. (accompanied by stretching the polyacrylonitrile-based fiber bundle at an elongation rate of −1.5%) to prepare a carbon fiber.

TABLE 1

| | Water content of precursor fiber for carbon fiber | Elongation rate (%) in each process: Preliminary flame-retardation | Flame-retardation | Carbon-ization | Elongation rate (%) of final carbon fiber to precursor fiber |
|---|---|---|---|---|---|
| Exp. 1 | 25 | 2.5 | 2.0 | 1.5 | 6.1 |
| Exp. 2 | 30 | 1.0 | 1.0 | 0.5 | 2.5 |
| Exp. 3 | 35 | −1.5 | −1.0 | −0.5 | −3.0 |
| Exp. 4 | 40 | 2.0 | 2.5 | 3.5 | 8.2 |
| Exp. 5 | 25 | 1.5 | 2 | 1.5 | 5.1 |
| Exp. 6 | 25 | −2.5 | 2 | 0.5 | −0.05 |
| Ref Exp. 1 | 25 | — | 1.5 | 1.5 | 3.0 |
| Comp. Exp. 1 | 4.5 | — | 2.5 | −1.5 | 1.0 |

(Remark)
elongation rate (%) in each process is based on each fiber in prior step.

The strengths of the carbon fibers obtained in Examples 1 to 6, Reference Example 1 and Comparative Example 1 were evaluated by the following method, and the results thereof are given in Table 2 below.

(1) Method of Evaluating the Strength of Carbon Fiber

The physical properties of carbon fibers were evaluated by fabricating strand evaluation equipment, impregnating carbon fibers with an epoxy resin and then straightly stretching the carbon fiber bundle based on JIS R760 with reference to Japanese Unexamined Patent Application Publication No. 2003-161681. Here, the distance between carbon fibers was 100 mm, the measuring speed was 60 mm/min, and the evaluation was performed 10 times.

TABLE 2

| | Strand strength (MPa) |
|---|---|
| Exp. 1 | 4600 |
| Exp. 2 | 4410 |
| Exp. 3 | 3500 |
| Exp. 4 | 4730 |
| Exp. 5 | 4480 |
| Exp. 6 | 3960 |
| Ref. Exp. 1 | 4070 |
| Comp. Exp. 1 | 2900 |

The invention claimed is:

1. A method of preparing a carbon fiber, comprising the steps of:

preparing a polyacrylonitrile-based polymer solution;

spinning the polyacrylonitrile-based polymer solution to prepare a precursor fiber for a carbon fiber, the precursor fiber having a water content of 20-50%;

converting the precursor fiber for a carbon fiber into a preliminary flame-retarded fiber while stretching the precursor fiber for a carbon fiber at an elongation rate of −10~−0.1% or 0.1~5% at 180~220° C. in air;

converting the preliminary flame-retarded fiber into a flame-retardant fiber while stretching the preliminary flame-retarded fiber at an elongation rate of −5~5% at 200~300° C. in air; and heating the flame-retardant fiber under an inert atmosphere to carbonize the flame-retardant fiber.

2. The method of preparing a carbon fiber according to claim 1, wherein the step of preparing the precursor fiber for a carbon fiber comprises the step of spinning the polyacrylonitrile-based polymer solution to form filaments and injecting the filaments into a coagulating bath to coagulate the filaments and then water-washing, stretching, oiling, drying and compacting the coagulated filaments.

3. The method of preparing a carbon fiber according to claim 1, wherein, in the step of converting the precursor fiber into the preliminary flame-retarded fiber, the precursor fiber is stretched at an elongation rate of 0.1~5%.

4. The method of preparing a carbon fiber according to claim 1, wherein, in the step of converting the preliminary flame-retarded fiber into the flame-retardant fiber, the preliminary flame-retarded fiber is stretched at an elongation rate of 0~5%.

5. The method of preparing a carbon fiber according to claim 1, wherein, in the step of carbonizing the flame-retarded fiber, the flame-retarded fiber is precarbonized at a temperature of 300~800° C. under an inert atmosphere, and is then stretched and carbonized at a temperature of 1000~3000° C. under an inert atmosphere.

6. The method of preparing a carbon fiber according to claim 5, wherein, in the step of carbonizing the flame-retarded fiber, the flame-retarded fiber is stretched at an elongation rate of −5.0~5.0%.

7. The method of preparing a carbon fiber according to claim 6, wherein, in the step of carbonizing the flame-retarded fiber, the flame-retarded fiber is stretched at an elongation rate of 3.1~5.0%.

8. The method of preparing a carbon fiber according to claim 1, wherein, after the step of preparing the precursor fiber for a carbon fiber, the stretching is performed such that a total elongation rate of the carbon fiber to the precursor fiber is −10.0~10.0%.

9. The method of preparing a carbon fiber according to claim 1, wherein, after the step of preparing the precursor fiber for a carbon fiber, the stretching is performed such that a total elongation rate of the carbon fiber to the precursor fiber is 5.1~10.0%.

* * * * *